US005345699A

United States Patent [19]

Gallon

[11] Patent Number: 5,345,699

[45] Date of Patent: Sep. 13, 1994

[54] SKI BOOT OF VARIABLE VOLUME WITH OVERLAPPING FLAPS

[75] Inventor: Denis Gallon, Feltre, Italy

[73] Assignee: Lange International S.A., Fribourg, Switzerland

[21] Appl. No.: 78,437

[22] Filed: Jun. 16, 1993

[30] Foreign Application Priority Data

Jul. 9, 1992 [CH] Switzerland ..... 2 170/92-1

[51] Int. Cl.[5] ..... A43B 5/04

[52] U.S. Cl. ..... 36/119; 36/54

[58] Field of Search ..... 36/117-121, 36/50.5, 54, 109

[56] References Cited

U.S. PATENT DOCUMENTS

| | | | |
|---|---|---|---|
| 4,308,674 | 1/1982 | Tessaro | 36/118 |
| 4,577,421 | 3/1986 | Sartor | 36/119 |
| 4,839,973 | 6/1989 | Dodge | 36/121 |
| 4,841,650 | 6/1989 | Dodge et al. | 36/119 |
| 5,003,710 | 4/1991 | Pozzobon | 36/117 |

FOREIGN PATENT DOCUMENTS

| | | | |
|---|---|---|---|
| 119566 | 9/1984 | European Pat. Off. | 36/117 |
| 0353532 | 2/1990 | European Pat. Off. . | |
| 0413089 | 2/1991 | European Pat. Off. . | |
| 2514207 | 10/1976 | Fed. Rep. of Germany | 36/117 |
| 3004668 | 8/1981 | Fed. Rep. of Germany | 36/117 |
| 2379263 | 10/1978 | France | 36/117 |
| 2498431 | 6/1981 | France . | |
| 2651648 | 3/1991 | France . | |

OTHER PUBLICATIONS

Italian Application "Struttura Di Scarpa Particolarmente Da Sci" Nov. 1973, No. 22791 B/73.

*Primary Examiner*—Paul T. Sewell
*Assistant Examiner*—Thomas P. Hilliard
*Attorney, Agent, or Firm*—Kane, Dalsimer, Sullivan, Kurucz, Levy, Eisele & Richard

[57] ABSTRACT

The boot, made of plastic material, comprises a shell of variable volume (1) having two longitudinal flaps (2, 3) which overlap on at least one part of the foot, and a shaft in the form of a collar (7) articulated on the shell. Only the flap (3) of the internal side of the boot extends at the same time over and at least in part above the instep. The missing part of the other flap (2) is replaced by an auxiliary piece (6) which is integral with a covering piece (5) which envelops the metatarso-phalangeal zone. Putting the boot on is facilitated by this, while a good transmission of the forces from the leg on the internal side of the boot for the edge grip is ensured.

10 Claims, 7 Drawing Sheets

SKI BOOT OF VARIABLE VOLUME WITH OVERLAPPING FLAPS

FIELD OF THE INVENTION

The present invention relates to a ski boot made of plastic material comprising a shell of variable volume surrounding the foot and the heel and having two longitudinal flaps which overlap on at least one part of the foot but only one of which extends at the same time on and above the instep, that is to say in the region of the lower leg, an auxiliary attached piece interacting with said one flap to cover the instep, a shaft in the form of a collar attached to the shell and means for clamping the shell and the collar.

PRIOR ART

From the document EP-A-0 353 532, a boot of this type is known, in which the auxiliary attached piece is constituted by a flap which is fixed laterally to the shell at one or two places and comes on the one hand to cover the instep with the flap of the shell extending above the instep and on the other hand to cover the transverse edge of the interrupted flap of the shell. The aim of this construction is to ensure optimum fixing of the foot on the inside of the boot and at the same time optimum adaptation to the foot of the skier. Account has not been taken of the fact that all the bearing on the ski takes place via the internal side of the boot, for in this construction the internal bearing takes place on an attached, and therefore not very rigid, piece and the transmission of the forces to the ski is not optimum. Moreover, the clamping of the foot takes place by means of a buckle acting on the auxiliary piece, that is to say close to the instep. With the two buckles of the collar, a boot with three buckles is obtained. In order to ensure good holding of the foot, however, it is necessary to have a fourth buckle further forward on the foot. However, by clamping the foot by means of a fourth buckle, there is a great risk of creating a space between the shell and the auxiliary piece in a case in which the clamping on the auxiliary piece is weaker than on the metatarsus, which is often the case for, close to the instep, it is suitable to leave the tendon of the foot a certain play to expand. The play created has the effect of putting an end to the impermeability of the boot and hence, ultimately, the necessity of renouncing the fourth buckle.

From Italian Patent Application no. 22791B/73, a boot is known furthermore, the shell of which has two slots extending parallel on each side of the foot and defining a tongue which covers the foot and the instep, this tongue being covered partially by a split sleeve which surrounds the shell and covers the slots. The extended tongue facilitates putting the boot on, but the slots greatly reduce the rigidity of the shell on each side of the latter and consequently its capacity for transmitting the forces to the ski.

From document FR-A-2 498 431, a boot made of plastic material is known moreover, the shell of which has an opening arranged along the instep intended to allow the introduction of the foot into the shell, this opening being covered by a tongue articulated on the front of the shell. This construction cannot, however, be used with a shaft in the form of a collar, but with a shaft in two parts in the form of a gutter.

SUMMARY OF THE INVENTION

The aim of the present invention is to produce a boot with a shell of variable volume and a shaft in the form of a collar, the putting on of which is facilitated without risk of a loss of impermeability and ensuring optimum transmission of the forces from the leg to the ski.

The boot according to the invention is characterised in that the flap of the shell extending to above the instep is the flap of the internal side of the boot and in that said auxiliary attached piece is integral with a piece for covering the metatarso-phalangeal zone.

The transmission of the forces from the leg on the internal side of the boot, to ensure the edge grip, is carried out directly on the shell itself and it is therefore much more effective.

Furthermore, since a continuity is ensured between the piece for covering the metatarsal zone and the auxiliary piece, a clamping which is differentiated at two points of the covering piece has no negative effect on the impermeability.

Moreover, it emerges that the release of the external side of the boot facilitates the introduction of the foot into the boot more than the release of the internal side.

The covering piece can be either enveloping, in the form of a band surrounding the shell over a little more than 360° in the closed and clamped position, or in the form of a cap held in position by clamping cables.

The auxiliary piece can be injection-moulded in one piece with the covering piece or otherwise attached, for example by ultrasonic welding or overmoulding. In this case, the auxiliary piece can advantageously have a strength and hardness which are different from that of the covering piece. The covering piece can thus be made of a relatively rigid material, for example of polyurethane loaded with KEVLAR (registered trademark), while the auxiliary piece is made of a more flexible material to facilitate putting the boot on. Such a structure can also be obtained by the bi-injection technique.

BRIEF DESCRIPTION OF THE DRAWINGS

The attached drawing shows by way of example some embodiments of the invention.

DESCRIPTION OF THE PREFERRED EMBODIMENT

Figure 1:
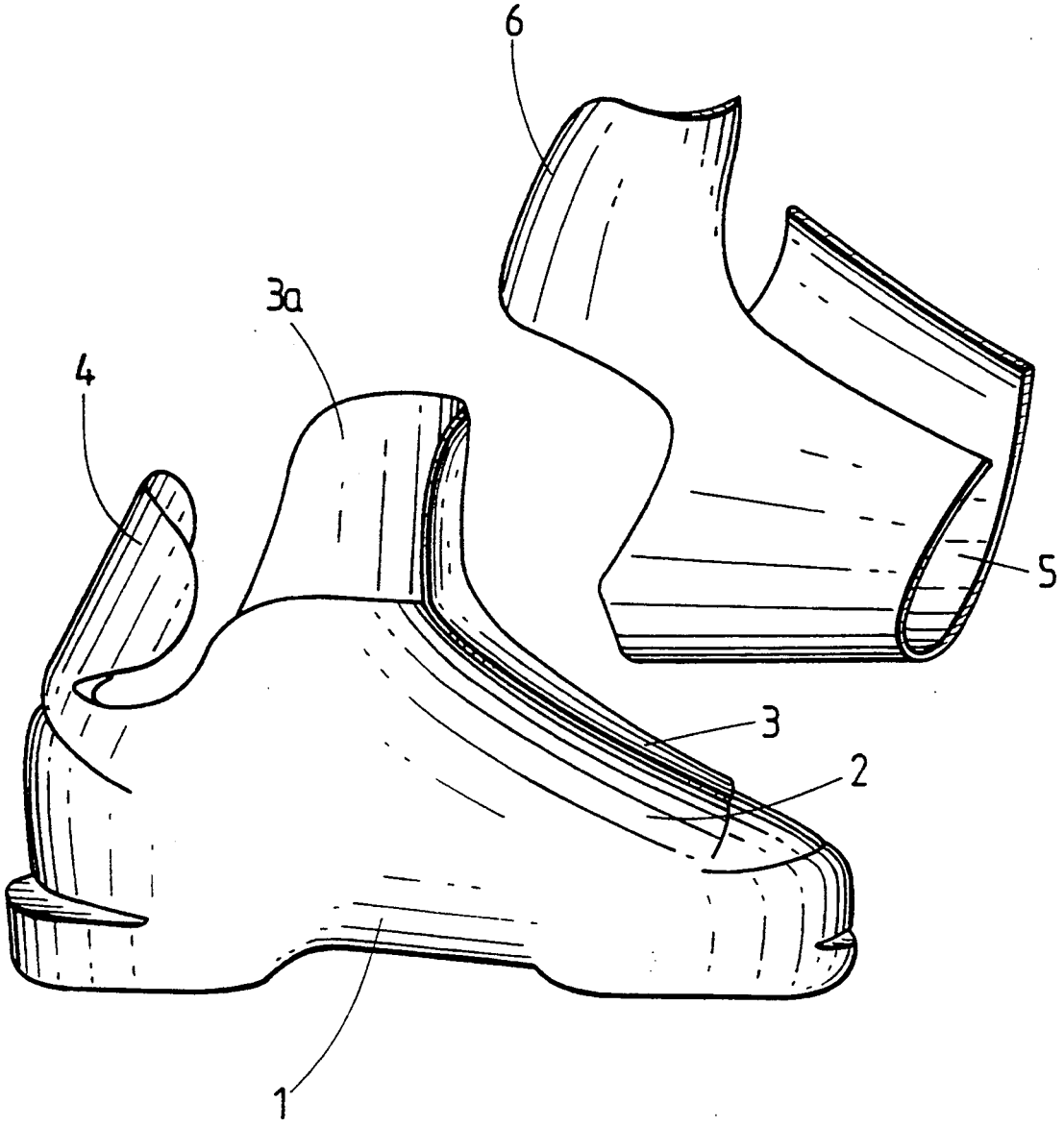
FIG. 1 is an exploded view in perspective of the constituent pieces of the shell of the boot according to a first embodiment.

FIG. 1 shows a shell 1, for example made of polyurethane, comprising the sole and surrounding the foot and the heel. This shell is of variable volume, that is to say that it can open according to a longitudinal line on the foot, this opening being obtained by two flaps 2 and 3.

The flap 2 stops a little above the malleolus, while the flap 3 extends over and above the instep via a part 3*a* which partially envelops the internal side of the ankle. At the rear, the shell 1 is equipped with a tongue 4 which comes to cover the Achilles' tendon.

The shell is completed by a covering piece 5 in the form of a collar, the external side of this collar being extended by an auxiliary piece 6 of curved shape which extends towards the top and towards the rear and has a shape which is approximately symmetrical to that of part 3*a*.

Figure 2:
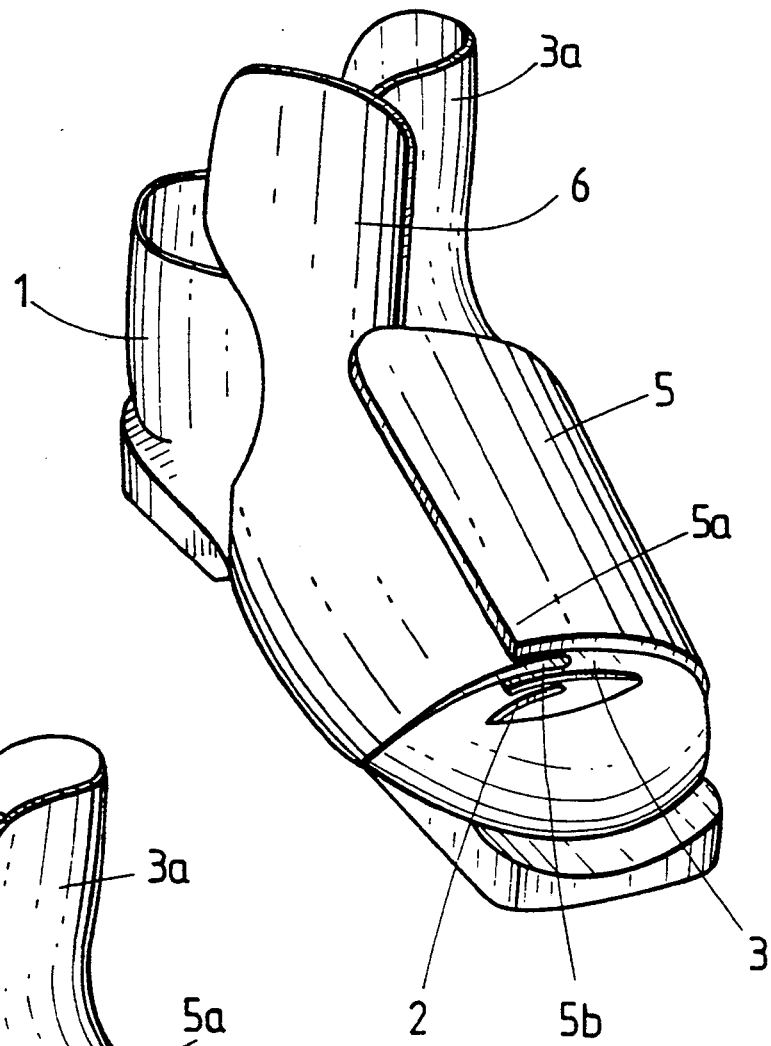
FIG. 2 is a view in perspective of the shell after assembly.

As shown in FIG. 2, the covering piece 5 comes to surround the shell 1 in the metatarso-phalangeal region, its ends forming two flaps 5*a* and 5*b* which come to overlap one another in the same manner as the flaps 2 and 3 of the shell. The auxiliary part 6 comes to cover the part left free by the flap 2 above the malleolus, thus replacing the missing part of the flap 2. The auxiliary part 6 is connected to the covering piece 5 by a relatively narrow part which facilitates flexion of the part 6 in this zone.

At the time of introduction of the foot into the boot, the auxiliary part 6 thus moves aside easily, facilitating the introduction of the foot into the shell.

The clamping of the metatarsal part of the shell is carried out by the clamping of the covering part 5, in the same manner as the clamping of a conventional shell of variable volume. The clamping buckles are fixed to the covering piece 5 so that it is not necessary to make a hole in the shell itself and so that the latter consequently has an advantageous continuity and a greater strength. The shell can also be lightened.

Repair of the boot in the event of tearing or tearing away of the buckles can be effected simply by changing the part 5, the shell itself not being involved.

Figure 3:
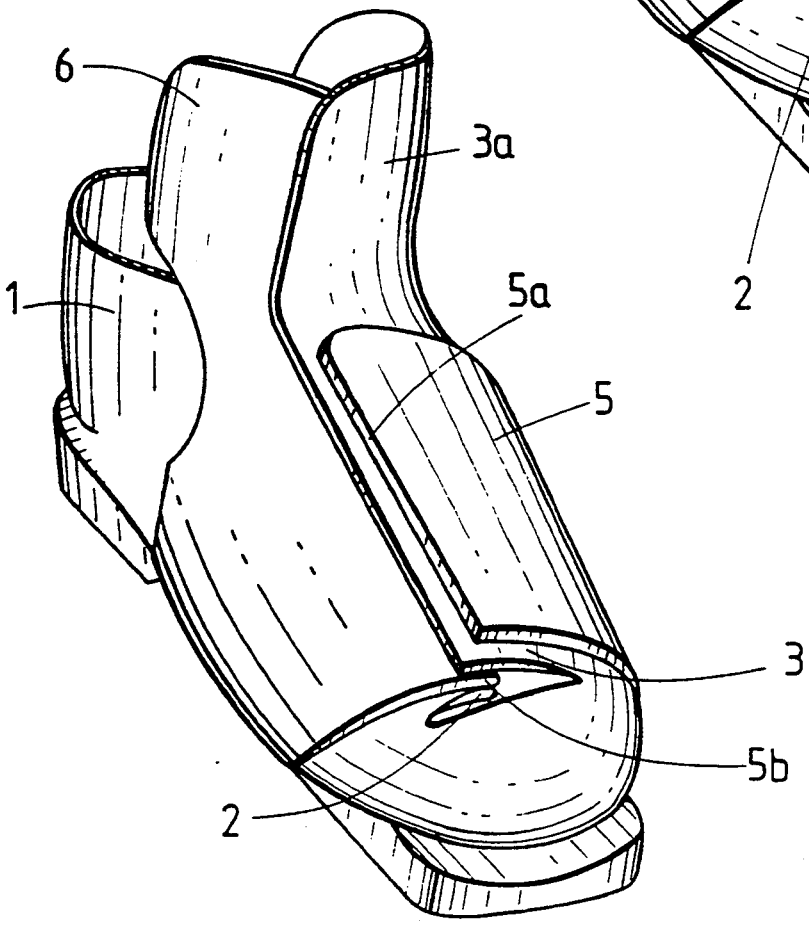
FIG. 3 shows an alternative embodiment of FIG. 2.

The shell 1 and the covering piece 5 can also be assembled as shown in FIG. 3. In this case, the flap 5*b* of the covering piece 5 is held between the lower flap 2 and the upper flap 3 of the shell, and the auxiliary piece 6 comes to the inside of the shell, under the part 3*a*. It is immediately noticeable that this solution has a better continuity between the metatarsal zone and the instep. The behavior in flexion of the boot in the region of the instep is thus better, as well as the impermeability.

Figure 4:
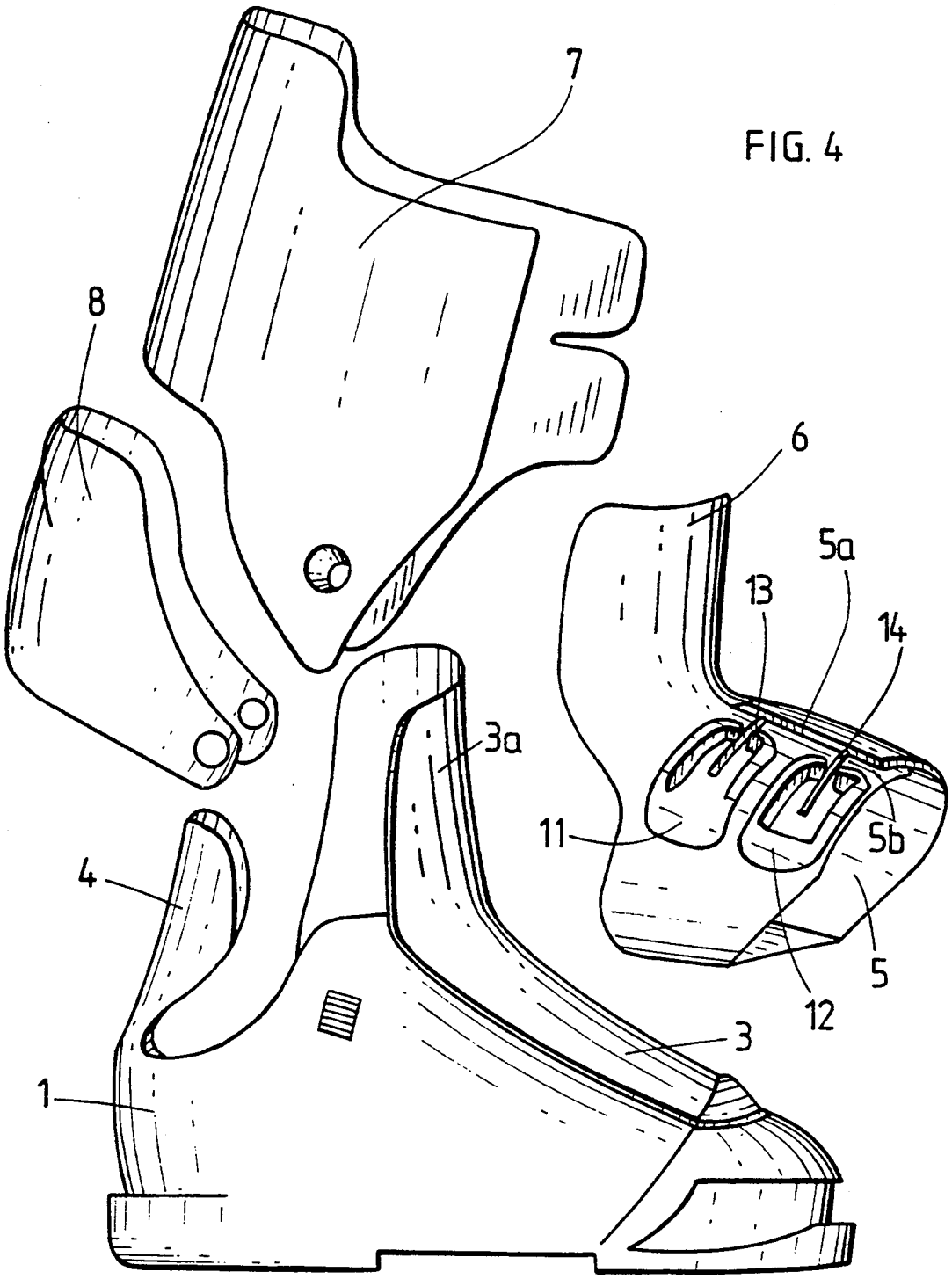
FIG. 4 is an exploded view of a shell with its shaft made according to the first embodiment.

The boot, the plastic elements of which are shown in an exploded view in FIG. 4, utilizes the same embodiment as FIG. 2. The shell is completed by a collar 7 which is articulated on the shell 1 and forms the shaft of the boot. This collar 7 is indented at the rear, the indentation being closed by a cap 8 which is also articulated on the shell. This construction is described in U.S. Pat. Nos. 4 839 973 and EP 0 286 586.

Figure 5:
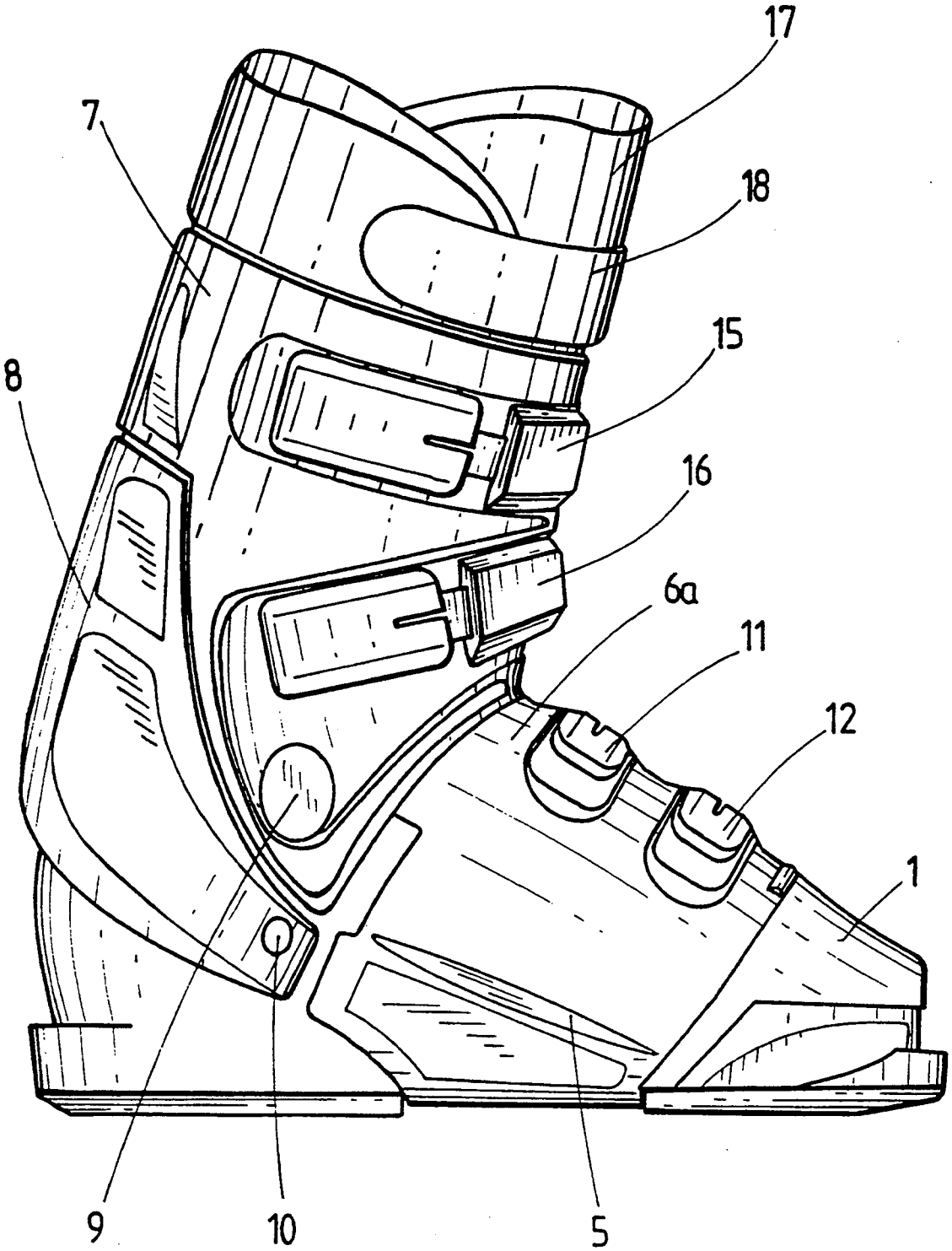
FIG. 5 shows a complete boot made according to FIG. 4.

FIG. 5 shows the same boot complete. The covering piece 5 and the start 6*a* of the auxiliary piece 6, here covered by the collar 7 articulated at 9 on the shell 1, can be distinguished. The cap 8 is articulated at 10 on the shell. The metatarsal part of the foot is clamped by means of two buckles 11 and 12 which are fixed to the external side of the covering piece 5 and make it possible to exert a traction on two cables 13 and 14 anchored in the flap 5*a* or further to the rear of the latter. The collar 7 is closed and clamped in a known manner by means of two buckles 15 and 16.

An inner boot 10 and a strap 18 for ensuring the support of the tibia during flexion can also be seen.

Figure 6:
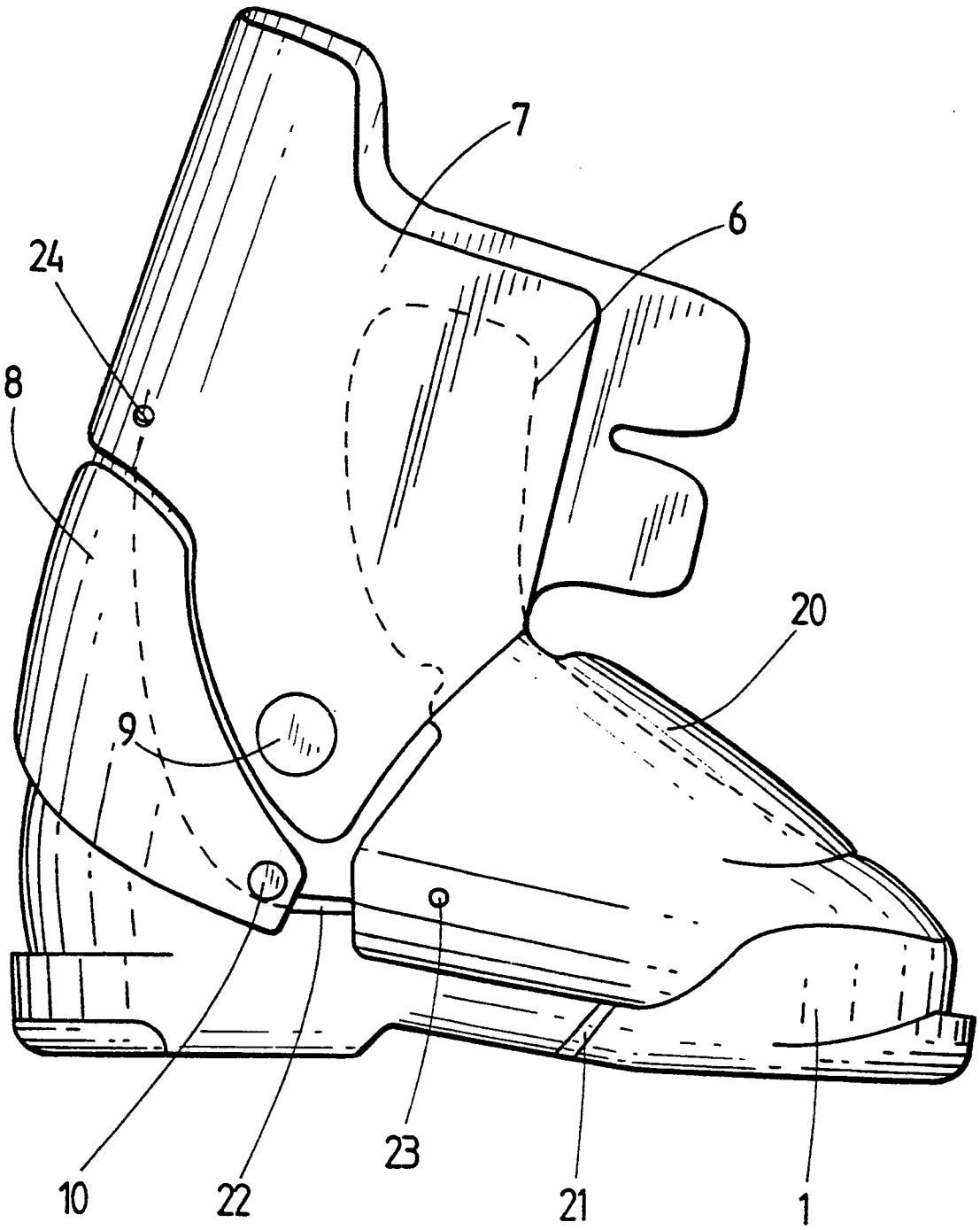
FIG. 6 shows a second embodiment of a complete boot without the buckles and tensioning lever.

FIG. 6 shows another embodiment, in which the covering piece is in the form of a cap 20. Attached to the cap 20 are cables such as cables 21 and 22, themselves connected to tensioning devices for the clamping of the metatarsus and of the instep. The cables can also serve for retaining the cap 20. The cable 21 can form a buckle on the other side of the cap 20. The cable 22 is anchored on the cap 20 at a point 23 and it passes below the articulation rivet 10 of the stirrup 8 to reemerge essentially vertically on the collar 7 via a passage 24 where it is attached to a tensioning lever (not shown) fixed to the collar.

Figure 7:
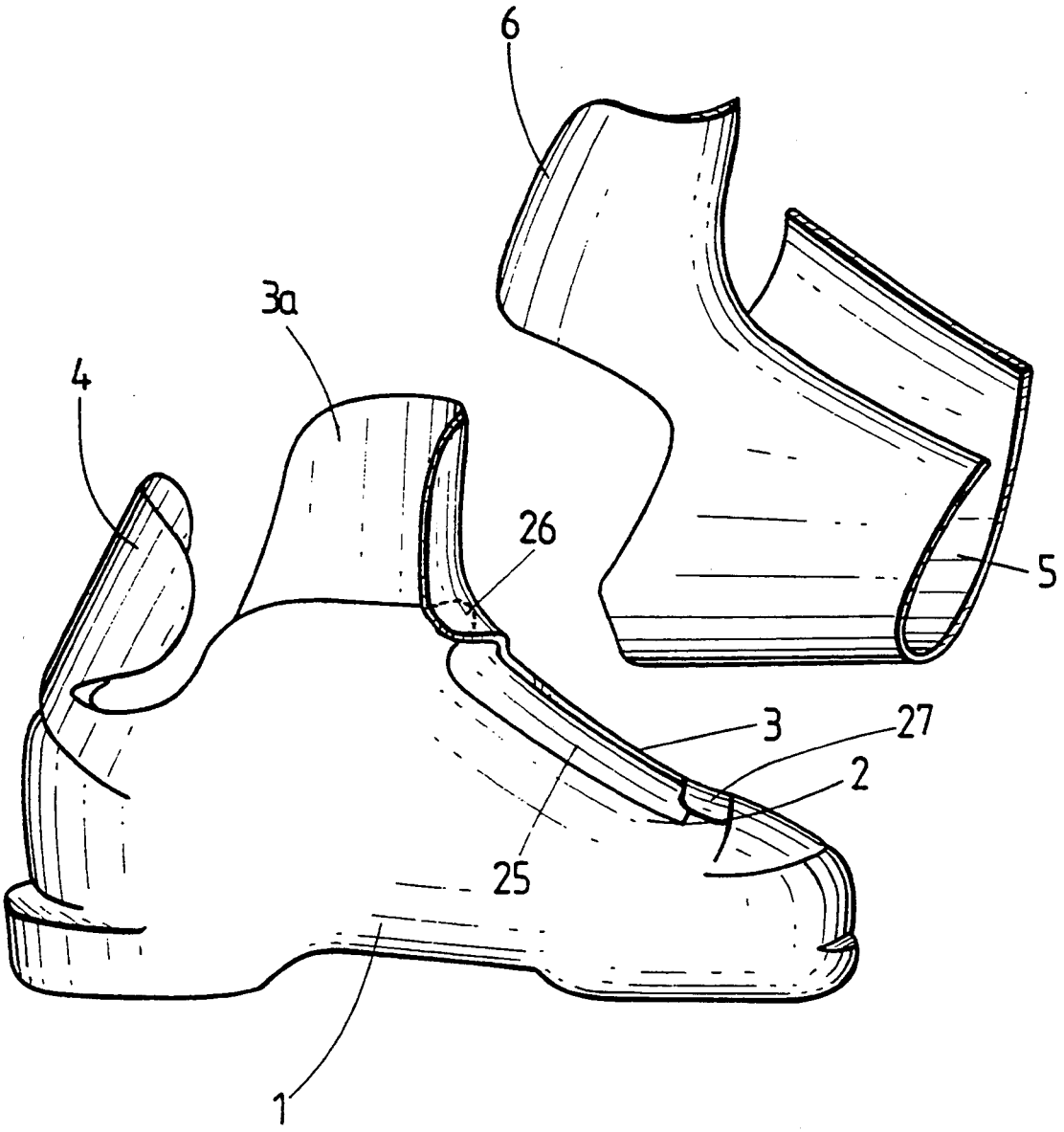
FIG. 7 is an exploded view, similar to FIG. 1, of a third embodiment.

A third embodiment is shown in FIG. 7. This embodiment differs from the first embodiment in that the shell 1 has a cutout 25 on the foot, allowing only the beginnings of flaps 2 and 3 to subsist except on the instep at 26 and at their front ends at 27 where they cover one another as in the first embodiment. The cutout 25 is covered by the covering piece 5.

Figure 8:
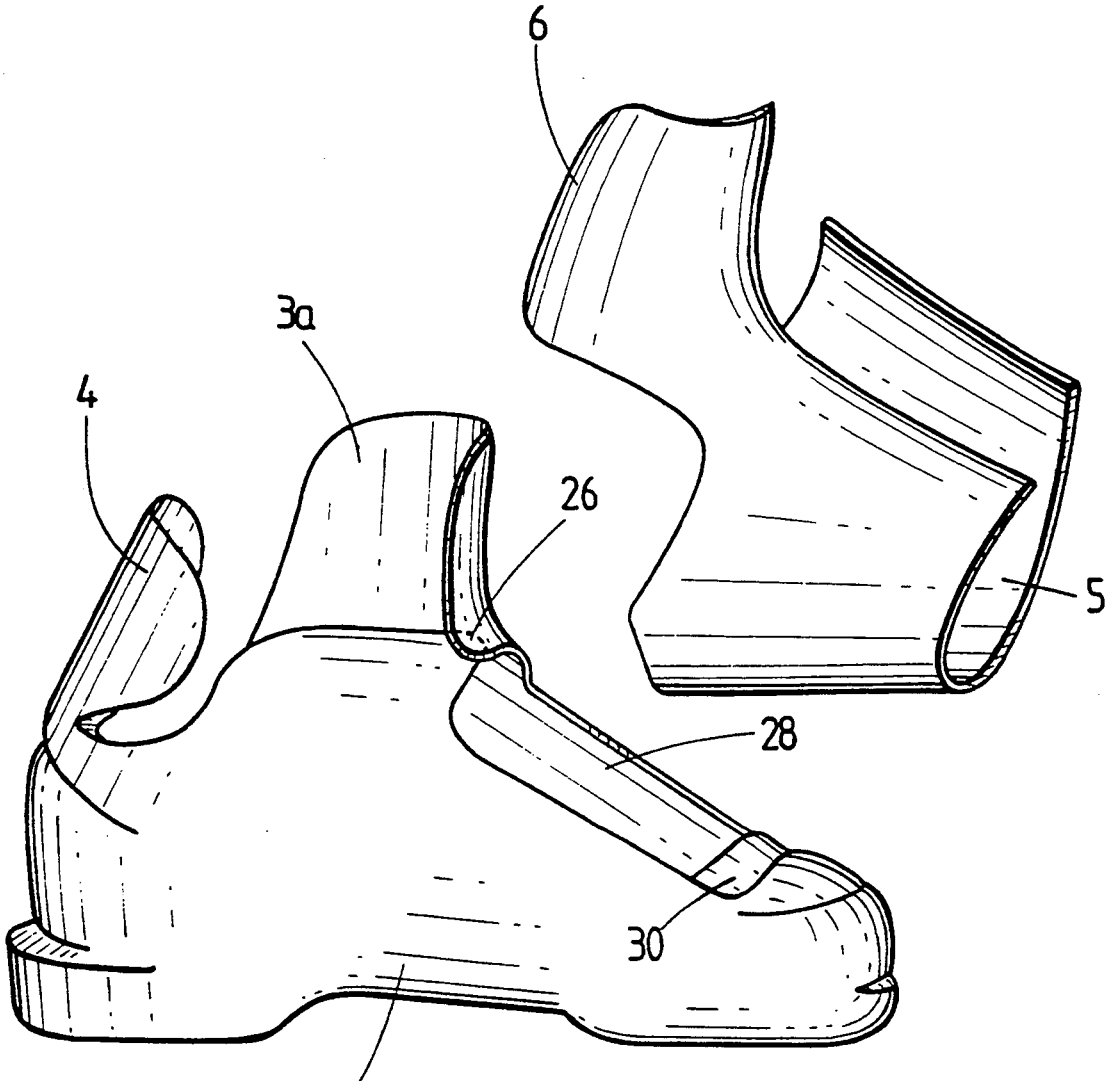
FIG. 8 is a similar view of a fourth embodiment.
Figure 9:
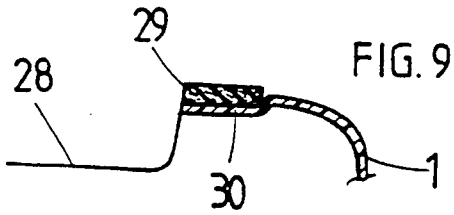
FIG. 9 is a detail of FIG. 8.

A fourth embodiment is shown in FIGS. 8 and 9. The latter is differentiated from the third embodiment in that the shell 1 has a cutout 28 which is similar to the cutout 25 but wider and extends to the front end of the flaps 2 and 3 so that these flaps are eliminated except at 26 on the instep. The covering piece 5 comes to cover the front of the cutout 28, the impermeability being ensured by a joint packing 29 stuck on a bearing surface 30 of the shell slightly set back from the surface of the shell.

I claim:

1. A ski boot made of plastic material comprising a shell of variable volume (1) surrounding the foot and the heel and having first and second longitudinal flaps (2, 3) which overlap on at least one part of the foot but only said second flap extending at the same time on and at least in part above the instep in the region of the lower leg, an auxiliary attached piece interacting with said second flap to cover the instep, a shaft in the form of a collar (7) attached to the shell and means for clamping the shell and the collar, wherein said second flap (3) of the shell extending above the instep is of the interior of the boot and wherein said auxiliary attached piece (6) is integral with a covering piece (5; 20) which envelopes the metatarso-phalangeal zone, said covering piece including tightening means.

2. The boot as claimed in claim 1, wherein the covering piece (5) is in the form of a collar passing under the shell, forming third and fourth flaps (5*a*, 5*b*) which coincide at least locally approximately with said first and second flaps of the shell, the auxiliary piece (6) constituting an extension of said fourth flap (5*b*) situated on an exterior of the boot.

3. The boot as claimed in claim 2, wherein said third and fourth flaps (5*a*, 5*b*) of the covering piece cover one another on the exterior of the shell and wherein said auxiliary piece (6) covers the edge of said second flap (3*a*).

4. A ski boot made of plastic material comprising a shell of variable volume (1) surrounding the foot and the heel and having first and second longitudinal flaps (2, 3) which overlap on at least one part of the foot but only said second flap extending at the same time on and at least in part above the instep in the region of the lower leg an auxiliary attached piece interacting with said second flap to cover the instep, a shaft in the form of a collar (7) attached to the shell and means for clamping the shell and the collar, wherein said second flap (3) of the shell extending above the instep is of the interior of the boot and wherein said auxiliary attached piece (6) is integral with a covering piece (5,20) which envelopes the metatarso-phalangeal zone, wherein the covering piece (5) is in the form of a collar passing under the shell, forming third and fourth flaps (5*a*, 5*b*) which coincide at least locally approximately with said first and second flaps of the shell, the auxiliary piece (6) constituting an extension of said fourth flap (5*b*) situated on an exterior of the boot, and wherein said fourth flap (5*b*) of the covering piece (5) comes to be interposed between said first and second flaps (2, 3) of the shell so that the auxiliary piece (6) also comes to engage under said second flap (3) of the shell in the region of the instep and above the instep.

5. The boot as claimed in claim 1, wherein said covering piece is in the form of a cap (20).

6. The boot as claimed in claim 5, wherein the cap (20) is retained by cables (21, 22) constituting a part of the means for clamping the foot.

7. The boot as claimed in claim 1, wherein the shell (1) has a cutout (25) on the foot and wherein said first and second flaps cover one another only on the instep (26) and at the front (27) of the foot.

8. The boot as claimed in claim 1, wherein the shell (1) has a cutout (28) on the foot, wherein said first and second flaps cover one another only on the instep (26) and wherein impermeability is effected at the front of the foot by a packing (29).

9. The boot as claimed in claim 1, wherein the auxiliary piece (6) has a rigidity and a hardness which are lower than those of the covering piece (5; 20).

10. The boot as claimed in claim 1, wherein the auxiliary piece (6) is made in one piece with the covering piece (5; 20).

* * * * *